United States Patent [19]

Sunder et al.

[11] Patent Number: 4,539,095

[45] Date of Patent: Sep. 3, 1985

[54] AQUEOUS ALKALI DEPOLYMERIZATION OF COAL WITH A QUINONE

[75] Inventors: Swaminathan Sunder; Robert N. Miller, both of Allentown, Pa.

[73] Assignee: Air Products and Chemicals, Inc., Allentown, Pa.

[21] Appl. No.: 602,024

[22] Filed: Apr. 19, 1984

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 2,133,280 | 10/1938 | Burk | 208/8 LE X |
| 2,286,823 | 6/1942 | McMillan | 208/45 X |
| 3,558,468 | 1/1971 | Wise | 208/8 LE |
| 3,642,607 | 2/1972 | Seitzer | 208/8 LE |
| 3,700,583 | 10/1972 | Salamony et al. | 208/8 LE |
| 3,850,477 | 11/1974 | Aldrich et al. | 208/8 LE X |
| 4,049,536 | 9/1977 | Plumlee et al. | 208/8 LE |
| 4,049,537 | 9/1977 | Plumlee et al. | 208/8 LE X |
| 4,051,012 | 9/1977 | Plumlee et al. | 208/8 LE |
| 4,057,484 | 11/1977 | Malek | 208/8 LE |
| 4,085,032 | 4/1978 | Aczel et al. | 208/10 |
| 4,085,033 | 4/1978 | Plumlee | 208/10 |
| 4,092,125 | 5/1978 | Stambaugh et al. | 44/1 R |
| 4,121,910 | 10/1978 | Stambaugh | 41/1 B |
| 4,159,240 | 6/1979 | Malek | 208/8 LE X |
| 4,369,140 | 1/1983 | Komatsu et al. | 260/369 |
| 4,428,821 | 1/1984 | Baset | 208/8 LE X |
| 4,448,665 | 5/1984 | Zaczepinski et al. | 208/8 LE |

*Primary Examiner*—D. E. Gantz
*Assistant Examiner*—William G. Wright
*Attorney, Agent, or Firm*—Geoffrey L. Chase; E. Eugene Innis; James C. Simmons

[57] ABSTRACT

A process is set forth for depolymerizing coal in an aqueous alkaline medium in the presence of a quinone and a hydrogen atmosphere. The depolymerized solid product is significantly ethyl acetate soluble and can be extracted with ammonia under supercritical conditions.

12 Claims, 1 Drawing Figure

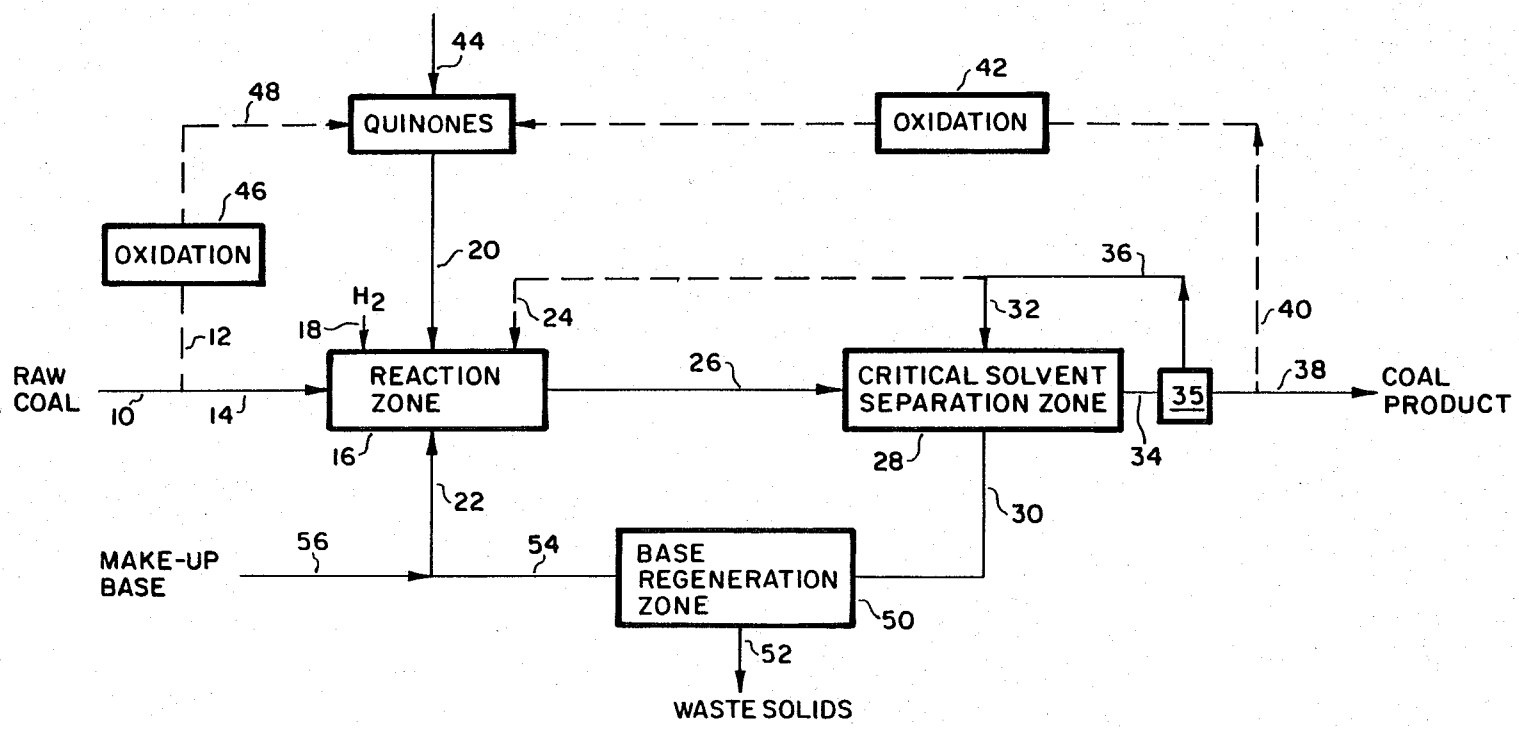
COAL PRODUCT
38
40
35
34
36
32
30
CRITICAL SOLVENT SEPARATION ZONE
28
42
OXIDATION
50
BASE REGENERATION ZONE
52
WASTE SOLIDS
26
24
54
44
QUINONES
20
REACTION ZONE
22
$H_2$
18
16
56
48
46
OXIDATION
12
14
10
RAW COAL
MAKE-UP BASE

AQUEOUS ALKALI DEPOLYMERIZATION OF COAL WITH A QUINONE

TECHNICAL FIELD

The present invention is directed to the field of coal processing. More specifically, the present invention is directed to the refining of a raw particulate coal into a depolymerized solid product which is more amenable to combustion as a solid fuel, a coal-water slurry or a gasifier feedstock. Further, the present depolymerization reaction provides an alternate refinement of coal from the hydrocarbon solvent liquefaction processes which provide liquid end product.

BACKGROUND OF THE PRIOR ART

Coal has been utilized in its raw state for industrial applications prior to the advent of environmental restrictions and the reduction in supplies of alternative fuels, predominantly from petroleum resources. During the 1930s, Germany led the advances in coal refinement to provide alternate fuel compositions from a raw coal source. These advances in coal refinement centered around the high pressure hyrogenation of coal in the presence of a hydrocarbon solvent. Despite the considerable improvements in such coal liquefaction, the solvent refining of coal remains an expensive process requiring complex flowschemes and apparatus to produce potentially liquid fuels and solid solvent refined coal material (SRC).

Not all industrial applications for coal require that the coal be refined or converted to liquid fuelstocks. Many heavy industry requirements necessitate only the desulfurization, demineralization or deashing of coals in order to make them amenable for combustion for power or heat. In order to render such coals readily combustible in appropriate industrial applications. it is desirable to at least partially refine or depolymerize the complex chemical structure of coal. Such depolymerization occurs when the bonds of a heteroatom in the predominantly carbon structure of coal is broken and is effectively capped with an agent such as hydrogen to prevent repolymerization. Depolymerization does not substantially affect carbon to carbon bonds in the coal molecular structure. Such depolymerized coal is more readily combustible than raw coal for industrial applications. However, the depolymerized coal does not constitute a liquid fuelstock, but rather a solid fuelstock which may be used in a solid, pulverized form referred to as neat coals or used in slurry form comprising a coal-water slurry. In the latter case. the coal is not solubilized, but rather is in suspension with emulsifying agents in a water phase. Alternately, such depolymerized coal could be suspended in an organic phase, such as a coal oil slurry.

In contrast to the refining of raw coal with hydrocarbon solvents, various techniques are known in the prior art for refining coal and more particularly deashing and desulfurizing coal in an aqueous system. In U.S. Pat. No. 4.121,910 a process is set forth wherein a bituminous or lower grade of coal in a finely dispersed solid form is contacted with an aqueous alkaline solution to separate out ash and sulfur components from the coal. The alkaline aqueous solution is made basic with sodium hydroxide or other hydroxides and combinations thereof. The treated coal is separated from the by-products by acidification of the basic reaction medium to precipitate the desired coal product from the dissolved by-product impurities remaining in the aqueous phase.

It is also known to use various quinones as hydrogenation catalysts in the more traditional hydrocarbon solvent liquefaction of coal. In U.S. Pat. No. 4,049,537, a process is set forth wherein a non-hydrogen donor solvent of a hydrocarbon composition is used in the liquefaction of coal wherein quinones are added to the reactor in order to enhance the dissolution of the feed coal to liquid product. The hydrogenation capability of quinones and their theoretical activity in the presence of coal materials and various carbon containing compositions, such as unsaturated carbon structures, is set forth.

Alternate methods for producing quinones are set forth in U.S. Pat. No. 4,369,140 where hydroanthraquinone is produced by a Diels-Alder reaction of naphthoquinone with a diolefin.

Finally, in a defensive publication in the U.S. Pat. Office published on April 22, 1969 in Volume 861 of the Official Gazette page 1020 by Hemminger, it is set forth that traditional solvent refined coal may be extracted using supercritical ammonia.

Additional art which is generally relevant to the process of the present invention includes: U.S. Pat. Nos. 3,700,583, 4,049,536, 4,051,012, 4,085,032, 4,085,033 and 4,092,125.

The present invention comprises a unique implementation of the various aspects of the prior art to provide an unexpected improvement in the depolymerization of solid raw coal to a solid coal product having increased solubility in part in ethylacetate and in part in pyridine. Such coal product has enhanced attributes for use in industrial combustion processes.

BRIEF SUMMARY OF THE INVENTION

The present invention is directed to a process for depolymerizing coal selected from the group of bituminous, sub-bituminous and lignite coal. by the treatment of the coal in an aqueous alkaline medium in the presence of a quinone, preferably hydroanthraquinone, at a temperature in the range of 110°-350° C. and at an elevated pressure in the range of 300–3000 psig.

Preferably the aqueous alkaline medium comprises an aqueous solution of sodium hydroxide. Further, the starting pH should be between 9–14 pH, preferably 13–14 pH.

The depolymerized coal in the aqueous alkaline reaction medium is preferably extracted from said medium with supercritical ammonia.

Preferably, the reaction is performed in the presence of a hydrogen atmosphere at a partial pressure in the range of 500 to 3000 psi. Optimally the hydrogen partial pressure is approximately 1500 psi.

The quinone should be present in the reaction medium in the range of 0.01 to 8 wt % based on feed coal. Preferably the quinone is present in the range of 1–5 wt %.

Optimally, the reaction is performed at a temperature of approximately 250° C.

BRIEF DESCRIPTION OF THE DRAWING

The FIGURE represents a schematic flowscheme of one preferred embodiment of the present invention.

DETAILED DESCRIPTION OF THE INVENTION

The process of the present invention has utility for converting low rank coals such as high-volatile bituminous coal, sub-bituminous coal or lignite to solid depolymerized coal products of greater value and greater utility for industrial and combustion requirements. The process converts fresh or raw coal, which is preferably in a particulate form, into a depolymerized coal product under conditions of mild hydrogenation in a reaction zone containing an aqueous alkali and a quinone under a hydrogen atmosphere at elevated temperatures between 110° C. and 350° C. The quinone enters the reaction scheme as a redox agent which provides a hydrogen-donor capability to the reaction medium in which hydrogen is transferred from the gas phase through the quinone to the depolymerizing coal structures. The quinones may be provided from any source, such as an external supply of fresh quinone, or preferably the quinones may be produced by an oxidation of a slipstream of the depolymerized coal product. Alternately, the quinones may be provided from the mild oxidation of a slipstream of the fresh or raw feed coal to the process. The depolymerized coal product is then extracted from the aqueous alkali reaction medium by any number of extraction techniques, such as acidification which allows the coal to precipitate out from solution or by supercritical extraction of the depolymerized coal in ammonia with subsequent pressure reduction of the ammonia phase with the resulting phase separation of the coal from the then gaseous state ammonia.

The process of the present invention contrasts from the known high pressure solvent refining processes for the conversion of coal to liquid and solid fuels wherein high consumption of hydrogen in non-selective hydrogenation and cracking of the coal occurs in concert with the production of hydrocarbon gases and the occurrence of repolymerization side reactions. The present process involves a mild reaction with selective hydrogenation, which reduces the hydrogen consumption of the reaction while at the same time essentially eliminating hydrocarbon gas formation and minimizing repolymerization reactions in the coal.

Under the conditions of the reaction sequence of the present invention, hydrolysis of oxygen linkages in the feed coal are believed to occur. For example, ethers are believed to undergo the following reaction:

$$\text{Coal-O-Coal}' + H_2O \xrightarrow{\text{NaOH}} \text{Coal-OH} + \text{Coal}'\text{-OH}$$

Under alkaline conditions many of the hydroxyl groups of the coal will be in anionic form and associated with a cation. This ionization capability of the alkali is believed to be responsible for the hydrolytic activity on the coal, especially at low temperatures. As the temperature is increased, free radical reactions may also play a part in the depolymerization and at such higher temperatures the opportunity for repolymerization is increased. When a quinone and molecular hydrogen are introduced into the alkali reaction mixture, the alkali readily catalyzes the reduction of the quinone to a hydrogenated form of the quinone, such as anthraquinone being reduced to tetrahydroanthraquinone. In turn, the hydrogenated quinone can transfer its labile hydrogen to the specific sites on the coal, such as the free radical and ionic sites mentioned above. These reactions can be exemplified as follows:

$$Q^* + H_2 \xrightarrow{\text{NaOH}} HQ$$

-continued $$\text{Coal} + HQ \xrightarrow{\text{NaOH}} \text{Coal-H} + Q^* = \text{quinone}$$

When low rank coal is subjected to a reaction in the manner described above, depolymerization and breakdown of the coal molecular structure takes place as indicated by enhanced solubility of the coal product in various organic solvents and aqueous bases. A very selective uptake of hydrogen is observed which accompanies this depolymerization or breakdown. Following the alkali and quinone treatment, the coal product can be recovered by various extraction techniques exemplified by the following methods:

(a) Separation can be achieved by neutralizing the slurry with carbon dioxide and then precipitating the coal with a stronger acid. It is also possible to add an amount of a sodium borate or diborate salt to the alkali that will upon concentration and heating displace the carbonate $CO_2$ formed during the $CO_2$ neutralization. In this way the base (sodium hydroxide) can be regenerated without the use of a conventional lime cycle. With the acidification method, there is observed a substantial reduction in the mineral matter content of the coal in excess of what is lost by acid treatment alone. Data indicate that certain aluminosilicates and pyrite are released from the coal when the alkali treatment is coupled with acidification.

(b) An alternate extraction method involves the separation of the coal product from the reaction slurry directly with ammonia at supercritical conditions. Direct extraction with ammonia eliminates the need for the direct acidification step. The ammonia can be used as both a recycle base and an extractant if desired.

The coal product which is extracted from the reaction medium is depolymerized almost completely to pyridine-soluble material (preasphaltenes) and at least substantially (up to 40%) ethylacetate or benzene-soluble materials (asphaltenes). The product is also substantially reduced in sulfur and inorganic matter content. The depolymerized coal with its low sulfur and ash content makes the product attractive as a boiler fuel in direct fired combusters or as a feedstock for slurry gasifiers and fluidized combusters. The presence of alkali metals in the slurry, such as sodium or potassium is very attractive for catalytic steam gasification. The base soluble nature of the product also makes it amenable for transport by slurry pipelines as a way to reduce the high transportation costs associated with moving coal to the marketplace.

The process of the present invention will now be described in greater detail with reference to the drawing. The process consists of three main zones: a reaction zone 16, a product separation zone 28 and a reagent recycle zone 50. The feedstock 10 comprises either peat, brown coal, lignite, sub-bituminous coal or bituminous coal of high volatility and low rank. The process works best when the feedstock is low enough in rank to contain a sufficient amount of etheric or esteric linkages for cleavage by the hydrolytic reaction. In the process, the raw coal (Preferably less than 18 mesh) is slurried with aqueous sodium hydroxide and a quinone under hydrogen pressure in the reaction zone 16. The quinone may be added either directly from an external source 44 to the process or from an oxidized slipstream 12 and 40 respectively from the feedstock coal 10 or the product stream 34. In the reaction zone 16 the feed coal is introduced in line 14 while aqueous base is introduced in line 22 and line 24. The quinone is introduced into the reaction zone in line 20 and hydrogen gas pressurizes the reactor by way of line 18. The reactor 16 is heated to a temperature between 110° C. and 350° C. and temperatures above this range are avoided in order to reduce the opportunity for condensation reactions within the structures of the coal. Following this reaction, the organic fraction of the coal is nearly completely solubilized in the reaction media.

The coal slurry from the reactor 16 is then pumped through line 26 to a separation zone 28 where the product is recovered. The separation zone 28 may include any process stage which would extract the coal material from the reaction media such as the acidification or the carbon dioxide treatment mentioned above, but preferably the extraction is performed using ammonia at supercritical conditions. In the separation zone 28 in a supercritical extraction, the slurry is mixed with a solvent and the pressure and/or temperature adjusted for extraction at supercritical conditions. In the case of ammonia as the extracting media, the depolymerized coal product is solubilized by the supercritical ammonia and the aqueous alkaline reaction media along with ash and sulfur components remain in the aqueous phase. The ammonia solvent as a separate phase containing the extracted depolymerized coal product is then separated from the depolymerized coal by adjusting either the pressure and/or temperature in zone 35. The solvent is removed as a vapor phase in line 36 and is recycled preferably in line 32 to the separation stage. The depolymerized coal is isolated in zone 35 as the o solvent goes to the vapor state. The depolymerized coal product is then removed in line 38 as a coal product. Because of the acidic nature of the depolymerized coal, the solvent is preferably a volatile base such as an organic amine or aqueous ammonia. When a volatile base is used as the solvent, it can also be used in the alkali treatment stage itself, so that a portion or all of it can be recycled to the main reactor in line 24. It is believed that the presence of a finite amount of an alkali metal such as sodium is definitely beneficial to achieve complete depolymerization of coal, but that portion of the total alkali content can be substituted by other bases such as ammonium hydroxide. For example the total alkali in the reaction zone could be comprised predominantly of ammonia in order to raise the pH to a sufficient level, but with enough alkali metal such as sodium, lithium or potassium to catalyze the reaction. The ammonia which is readily volatile could then be easily recycled while the alkali metal can be recovered from the bottoms from the separation zone and recycled or even disposed.

In the preferred embodiment in which sodium hydroxide is the alkali chosen from the reaction zone 16, the alkali is recovered in the solvent separation zone 28 in the aqueous phase and is removed in line 30 to the base regeneration zone 50. In this zone 50, separation is performed to remove waste solids in line 52 which are comprised of sulfur compounds and ash derived from the feed coal. The aqueous base is then recycled in line 54 and introduced into the reaction zone 16 in line 22. A certain amount of makeup base will be necessary to sustain a continuous reaction and this is introduced in line 56.

The quinones may be added to the reaction zone from an external source 44 or alternately by oxidation in oxidation zones 46 and 42, respectively. These oxidation zones operate on a slipstream 12 and 40 of the coal feed 10 or coal product 38. The oxidation of these coal materials produces various quinones which are then recycled to the reaction zone 16 through line 20.

As recited above, the use of critical solvent to extract the depolymerized coal from the aqueous alkali reaction media is considered the preferred embodiment of the present invention, but it is also contemplated that other extraction techniques may be utilized such as acid neutralization of the alkali media or carbon dioxide neutralization. These alternate extraction techniques are not illustrated but are deemed to be well within the skill of those working in the art.

The present invention will further be described with greater detail in the following examples.

In all cases, the depolymerization experiments defined in the examples were conducted in a 300 cc stirred-autoclave reactor at the vapor pressure of water at reaction temperature for 2 hours. Whenever molecular hydrogen was used, it was an additional partial pressure of 1500 psig under reaction conditions. The cooled mixture which contained the base. undissolved solids, and dissolved coal product was acidified with concentrated HCl until pH=2. The precipitate that formed upon acidification was centrifuged and washed repeatedly with distilled water to remove excess salts (final pH≃3 to 4). The recovered solid was then dried in vacuo at 70° C. and weighed to determine mass recovery.

The acid-insoluble precipitate was then subjected to sequential Soxhlet extraction using ethylacetate followed by pyridine to determine the relative increase in solubility which is related to the extent of depolymerization of the coal. The ethylacetate and pyridine extracts were evaporated to dryness in a rotary evaporator to obtain weight of the extracts. Product solubilities reported in the experiments were calculated on a dry and ash-free basis as a percent of the acid-insoluble product.

The preparations of the coal samples for the four extractions described in Example 6 and Table 5 were as follows:

Exp. 6A—This raw coal was equilibrated in a 50% relative humidity atmosphere until the said moisture content was reached.

Exp. 6B—The coal was treated in aqueous NaOH at 250° C. for 2 hr, precipitated by acid neutralization to pH=2, washed, centrifuged, and dried.

Exps. 6C and 6D were processed the same as Exp. 6B except that they were not dried.

Coal samples prepared as described above were placed in a 100 ml high pressure vessel and continuously extracted with anhydrous ammonia or an ammonia/water mixture at 5 cc/min (about 3.2 g/min). After equilibration to extraction temperature and pressure, which normally took about 10 minutes, the sample was extracted for 80 minutes. The extract was precipitated by decreasing the temperature and pressure to ambient conditions in a separator, and the product collected at 20 minute intervals, ensuring thereby that the extraction was complete. The vessels were then flushed out with water to avoid contamination with organic solvents and all the extract fractions and residues were dried in vacuo at 90° C. Table 5 shows the total extract yields, as well as the material balances.

EXAMPLE 1

Hydrogenation of Anthraquinone in Aqueous Solution By Molecular Hydrogen

This example illustrates the hydrogenation reaction of anthraquinone in aqueous NaOH with molecular hydrogen. 2 gm of anthraquinone was mixed in a 300 cc batch autoclave with 7 gms of NaOH, 100 ml of water and 1000 psi hydrogen. The mixture was reacted at 170° C. for 2 hours and cooled. From the final pressure reading the hydrogen consumption was estimated to be approximately one mole consumed per mole of anthraquinone fed. The product consisted of unreacted yellow anthraquinone (which is insoluble in aqueous NaOH) and a purple solution which is characteristic of the ionized form of the hydroanthraquinone. The presence of the hydroanthraquinone was confirmed by bubbling air through the decanted purple solution which readily oxidized to form a yellow precipitate of anthraquinone.

When the experiment was repeated at 250° C., four moles of hydrogen were consumed per mole of anthraquinone.

TABLE 1

COMPOSITIONAL ANALYSIS OF (DEPOLYMERIZED AND RAW) KENTUCKY #9 BITUMINOUS COAL AND NORTH DAKOTA BEULAH LIGNITE

| | BEULAH LIGNITE | | KENTUCKY #9 | |
|---|---|---|---|---|
| | RAW | TREATED** EXAMPLE 4C | RAW | TREATED** EXAMPLE 5B |
| % dry, ash-free | | | | |
| Carbon | 72.5 | 72.1 | 75.0 | 82.1 |
| Hydrogen | 4.3 | 5.3 | 4.6 | 5.6 |
| Oxygen | 21.5 | 19.0 | 10.5 | 9.6 |
| Nitrogen | 1.2 | 0.9 | 1.7 | 1.7 |
| Sulfur | 0.5 | 0.4 | 5.0 | 2.4 |
| Volatile Matter | 41.0 | 46.4 | 36.8 | 41.5 |
| BTU/lb (dry, ash-free)* | 11880 | 12740 | 13190 | 14780 |
| % ash (dry) | 10.0 | 1.5 | 9.9 | 2.5 |

*Calculated from Mott-Spooner Formula
**Acid-insoluble Product

EXAMPLE 2

Aqueous-Phase Reactions of Lignite in Alkali

2A: Sodium Hydroxide Treatment of Lignite

This example illustrates the reaction of coal in the presence of aqueous NaOH alone. An as received North Dakota lignite (Beulah seam), whose composition is shown in Table 1. was reacted in a 300 cc batch autoclave with aqueous NaOH (0.42 gm/gm dry coal) for 2 hours at 250° C. under the vapor pressure of water at reaction temperature. The acidified product from the reaction was extracted with ethyl acetate and pyridine to determine conversion. Data shown in Table 2 indicate that 87% of the coal's organic matter has been converted to soluble material with as much as 23% soluble in ethyl acetate. For comparison, Table 2 shows that only 2.3% is extracted from the raw untreated coal by ethyl acetate.

2B: Sodium Hydroxide/Hydrosulfide Treatment of Lignite

This example illustrates the reaction of the North Dakota lignite (composition as in Table 1) in the presence of aqueous NaOH with $Na_2S$ added as catalyst (0.18 gm $Na_2S$/gm dry coal). A mixture of coal, aqueous NaOH and $Na_2S$ was reacted at the same condition described in Example 2A. The reaction product distribution is shown in Table 2. Addition of $Na_2S$ appears to enhance conversion such that essentially all of the coal is now soluble in pyridine.

2C: NaOH/$H_2$ Treatment of Lignite

This example illustrates the reaction of a North Dakota lignite (composition as in Table 1) in the presence of aqueous NaOH and under 2000 psi $H_2$ pressure. No quinone was added in the experiment. The reaction conditions were similar to example 2A. As seen in Table 2, the conversion yield of ethyl acetate solubles (27.7%) is in the same range as that from the plain NaOH or the NaOH/$Na_2S$ treatment. Addition of $H_2$ alone does not increase the conversion significantly.

EXAMPLE 3

Aqueous-Phase Hydrogenation of Lignite with Hydroanthraquinone and Molecular $H_2$ This example illustrates the reaction of North Dakota lignite (composition as in Table 1) in the presence of aqueous NaOH, added hydroanthraquinone and molecular hydrogen. The coal, aqueous NaOH and hydroanthraquinone (0.15 gm/gm dry coal) mixture was pressurized to 1000 psi with gaseous $H_2$ at 20° C. in a 300cc batch autoclave and then reacted at 250° C. for 2 hours as in Examples 2A and 2B. A net consumption of molecular hydrogen of 0.025 moles was noted at the end of this reaction. As seen in Table 3, the product from the reaction. corrected for the presence of anthraquinone, had a hydrogen content of 5.2% (dry, ash-free coal); this represents a 0.5% increase over the products from Examples 2A and 2B and nearly a 1% increase over the untreated coal. The product was again completely converted to pyridine soluble material, but in this case there was a significant improvement of 10% in ethyl acetate extraction yield (36.0% daf).

TABLE 2

CONVERSION OF NORTH DAKOTA LIGNITE BY AQUEOUS ALKALINE TREATMENT

| | EXTRACTION OF UNREACTED COAL | EXAMPLE 2A NaOH TREATMENT | EXAMPLE 2B NaOH/$Na_2S$ TREATMENT | | EXAMPLE 2C NaOH/$H_2$ TREATMENT | EXAMPLE 3 NaOH/$H_2$ HYDROANTHRAQUINONE TREATMENT |
|---|---|---|---|---|---|---|
| Reaction Temp., °C. | — | 250 | 250 | 250 | 250 | 250 |
| Reaction Time, Min. | | 120 | 120 | 120 | 120 | 120 |
| Conversion Yields (%; dry, ash-free coal) | | | | | | |
| Ethyl Acetate Solubles | 2.3 | 23.3 | 27.1 | 24.3 | 27.7 | 36.0 |
| Pyridine Solubles | 3.7 | 64.1 | 72.9 | 75.7 | ND | 64.0 |
| Pyridine Insolubles | 94.0 | 12.6 | <1 | <1 | ND | <1 |
| Elements (%; dry, ash-free coal) | | | | | | |
| H | 4.3 | 4.7 | 4.5 | 4.7 | ND | 5.2 |

TABLE 2-continued

| CONVERSION OF NORTH DAKOTA LIGNITE BY AQUEOUS ALKALINE TREATMENT | | | | | |
|---|---|---|---|---|---|
| | EXTRACTION OF UNREACTED COAL | EXAMPLE 2A NaOH TREATMENT | EXAMPLE 2B $NaOH/Na_2S$ TREATMENT | EXAMPLE 2C $NaOH/H_2$ TREATMENT | EXAMPLE 3 $NaOH/H_2$ HYDROANTHRAQUINONE TREATMENT |
| S | 0.5 | 0.5 | 2.5 2.2 | ND | 0.3 |

ND - Not determined

EXAMPLE 4

Aqueous-Phase Hydrogenation of Lignite with Anthraquinone and Molecular $H_2$ This example illustrates the reaction of North Dakota lignite (Table 1) in the presence of aqueous NaOH, gaseous hydrogen and anthraquinone at various concentrations less than used in Example 3. This example differs from Example 3 in that the quinone is added in the dehydrogenated state. Reaction conditions were similar to those used in Example 2 and 3, except that the hydrogen partial pressure was maintained at 1500 psi. The anthraquinone additions for the example experiments 4A, 4B, 4C and 4D, shown in Table 3, were 0.007, 0.026, 0.052, and 0.079 gm anthraquinone/gm dry coal, respectively.

As seen in Table 3, the conversion to ethyl acetate solubles in these experiments increases with an increase in the anthraquinone concentration and levels off at about 38%. At the higher concentrations, nearly 100% of the organic material is soluble in pyridine, as in Example 2B. Thus, it can be seen that a 15% increase in lower molecular weight products (the ethyl acetate extract) can be obtained with less than 0.5 wt % molecular hydrogen consumed. The use of anthraquinone seems to be very selective in its reduction/depolymerization reaction of the coal.

EXAMPLE 5

Aqueous-Phase Hydrogenation of Bituminous Coal With Anthraquinone and Molecular $H_2$ This example illustrates the reaction of bituminous coal under the presence of aqueous NaOH, anthraquinone and molecular $H_2$. The coal used (composition shown in Table 1) a Kentucky #9 seam, high volatile bituminous. The reaction was carried out at 250° C. for 2 hours in 2 experiments where the concentration of anthraquinone was varied from 0.01 to 0.04 gm AQ/gm dry coal.

Data shown in Table 4 indicate that very little change in the solubility of the depolymerized products occurs when the coal is reacted in alkali without AQ or $H_2$ present. However, it is quite clear that addition of AQ and $H_2$ significantly increases the combined solubility in pyridine and ethylacetate by as much as 28%. Elemental analysis of the products from this reaction (shown in Table 1) shows that the hydrogen content has increased by as much as 1 wt % (daf) over that of the raw coal.

As was concluded for the lignite, the use of anthraquinone seems to be very selective in its reduction/depolymerization reaction with coal.

TABLE 3

| CONVERSION OF NORTH DAKOTA LIGNITE BY AQUEOUS PHASE HYDROGENATION AS A FUNCTION OF ADDED ANTHRAQUINONE | | | | | | |
|---|---|---|---|---|---|---|
| | | NaOH | NaOH, $H_2$, ANTHRAQUINONE TREATMENT | | | |
| | EXTRACTION OF UNTREATED COAL | TREATMENT EXAMPLE 2A | EXAMPLE 4A | EXAMPLE 4B | EXAMPLE 4C | EXAMPLE 4D |
| gm AQ/gm dry coal | — | 0 | 0.007 | 0.026 | 0.052 | 0.079 |
| $H_2$ partial pressure, psig | — | 0 | 1500 | 1500 | 1500 | 1500 |
| Reaction Temp., °C. | — | 250 | 250 | 250 | 250 | 250 |
| Reaction Time, Min. | — | 120 | 120 | 120 | 120 | 120 |
| Conversion Yields (% dry, ash-free coal) | | | | | | |
| Ethyl Acetate Solubles | 2.3 | 23.3 | 30.4 | 33.6 | 38.4 | 38.1 |
| Pyridine Solubles | 3.7 | 64.1 | 64.2 | 66.4 | 61.6 | 61.9 |
| Pyridine Insolubles | 94.0 | 12.6 | 5.4 | <1 | <1 | <1 |

TABLE 4

| AQUEOUS HYDROGENATION OF KY #9 BITUMINOUS COAL | | | | |
|---|---|---|---|---|
| | | NaOH | $NaOH/H_2$/ANTHRAQUINONE TREATMENT | |
| | EXTRACTION OF UNREACTED COAL | TREATMENT EXAMPLE 5A | EXAMPLE 5B | EXAMPLE 5C |
| gm AQ/gm dry coal | | 0 | 0.01 | 0.04 |
| $H_2$ pressure, psig | | 0 | 1500 | 1500 |
| Reaction Temp., °C. | | 250 | 250 | 250 |
| Reaction Time, min. | | 120 | 120 | 120 |
| Conversion Yields (% dry, ash-free coal) | | | | |
| Ethyl Acetate Solubles | 2.8 | 7.8 | 11.5 | 11.3 |
| Pyridine Solubles | 23.5 | 25.1 | 45.3 | 46.2 |
| Pyridine Insolubles | 73.7 | 67.1 | 43.2 | 42.5 |

EXAMPLE 6

Supercritical Ammonia Extraction of Sodium Hydroxide-Treated Lignite

This example illustrates the enhanced extractability of moist, NaOH-treated coal by supercritical ammonia, and compares the results with those of supercritical ammonia extraction of untreated coal and with conventional supercritical toluene extraction.

About 50gm of Beulah lignite (composition as in Table 1) was treated at 250° C. and aqueous NaOH for 2 hours (as in Example 2A); from this reaction a product was precipitated by 6N HCl, washed with distilled water and used for the extractions listed in Table 5.

To establish a reference solubility in $NH_3$, a sample of the moist NaOH-treated lignite was leached with dilute $NH_4OH$ solution under ambient conditions for 7 days. The yield of extract was 90 wt %.

Two samples (Runs 6C and 6D of Table 5) of the NaOH-treated coal, with incipient moisture contents between 80–90%, were extracted in a 100 cc semi-continuous research unit by supercritical ammonia under conditions corresponding to a Hildebrand solubility parameter of 4.4 and 9.7; as seen in Table 5, the yield of extract after only 60 minutes was significant, being 43.7 and 67.7%, respectively.

When untreated coal (with 40% incipient moisture) was extracted under similar conditions with supercritical ammonia (as in run 6A in Table 5) only 3.1% extract was obtained, proving the gross effect of alkali treatment. Also, if the NaOH-treated coal was dried prior to supercritical extraction, only 7.3% extract is obtained verifying the mportance of water as a co-solvent (Run 6B of Table 5).

the alkali treatment and the supercritical separation as one stage.

For comparison, the raw Beulah Lignite and a sample treated by $NaOH/Na_2S$ at 210° C. (as in Example 2B) were extracted by the conventional supercritical toluene method (400° C., 3000 psi). As pointed out in the literature, only a moderate yield (23.5%) for the raw coal was obtained. The alkali treatment did not appear to have any positive effect on supercritical toluene extraction as the yield decreased to 18.2%. In contrast, the ammonia supercritical extraction of the alkali-treated coal has succeeded in extracting as much as three times more material than toluene supercritical extraction of either raw or treated coal.

EXAMPLE 7

Aqueous-Phase Reactions of Wyodak Subbituminous Coal in Alkali-Effect of Base Concentration This experiment illustrates the effect of alkali concentration on the depolymerization of Wyodak subbituminous coal under aqueous alkali. The composition of this coal (on a dry and ash-free basis) was as follows: Carbon, 69.9%; Hydrogen, 5.3%; Oxygen, 21.3%; Nitrogen, 1.0%; Sulfur, 0.9%; Volatile matter 49.6%. The ash content was 8.5 wt %. The experimental results are given in Table 6.

For Example 7A (in Table 6), coal, water (9.5 gm/gm dry coal) and NaOH (0.013 gm/gm dry coal) were reacted under the vapor pressure of water at 170° C. for two hours and cooled. The acidified product was extracted with ethylacetate and pyridine to determine conversion to solubles. As shown in Table 6, the total solubles increased by 15.1% over that of the unreacted coal.

TABLE 5

SUPERCRITICAL AMMONIA EXTRACTION OF NaOH-TREATED LIGNITE

| RUN NO. | INCIPITENT MOISTURE, % | TREATMENT CONDITION | MOLE % $H_2O$ in $NH_3$ | EXTR. TEMP. °C. | $T_c$ | EXTR. PRESS. PSIA | $P_c$ | [1] δ | SOLV./DRY COAL FEED RATE; gm/gm. min. | TIME AT COMPLETION min. | EXTR. YIELD WT % | MASS BALANCE WT % |
|---|---|---|---|---|---|---|---|---|---|---|---|---|
| 6A | 40.1 | Raw Coal | 0 | 140 | 132 | 3500 | 1654 | 9.7 | 0.28 | 80 | 3.1 | 100.5 |
| 6B | 0.4 | NaOH | 7.6 | 180 | 170 | 3000 | 2300 | 6.6 | 0.30 | 60 | 7.3 | 96.7 |
| 6C | 83.0 | NaOH | 0 | 180 | 132 | 3000 | 1654 | 4.4 | 0.40 | 40 | 43.7 | 97.6 |
| 6D | 89.7 | NaOH | O | 140 | 132 | 3500 | 1654 | 9.7 | 0.28 | 60 | 67.7[2] | 82.0 |

[1]δ = Hildebrand Solubility Parameter
[2]Represents minimum yield; Extract is 83%, if based on total recovered dry solids These results illustrate that the NaOH has changed the chemistry of the lignite in such a way so as to render it nearly completely soluble in ammonia as evidenced by the 90% solubility after ambient $NH_4OH$ leaching. However, extraction at a supercritical condition with a solubility parameter of the solvent similar to that of coal (9.5–10.0) produces an extract yield closely approaching the upper limit from the ambient extraction, but in a markedly shorter time. Since water is indigenous to the alkali treatment, its beneficial effect in increasing the extraction yield enhances the possibility for operating Example 7B (in Table 6) was the same as Example 7A except that 0.13 gm NaOH/gm dry coal was used. The total conversion increased by 10.7% over that of Example 7A.

Example 7C was also similar to 7A and 7B except that 0.44 gm NaOH/gm dry coal was used. The total conversion increased by 10.6% over that of Example 7B.

The results from these examples show that conversion to soluble products increases with increase in the amount of NaOH added and begins to level off at about 0.4 gm NaOH/gm dry coal.

TABLE 6

CONVERSION OF WYODAK SUBBITUMINOUS COAL BY AQUEOUS ALKALI TREATMENT

| | Extraction of Unreacted Coal | Aqueous NaOH Treatment Example 7A | Example 7B | Example 7C |
|---|---|---|---|---|
| gm NaOH/gm dry coal | — | 0.013 | 0.13 | 0.44 |
| Reaction Temp., °C. | — | 170 | 170 | 170 |
| Reaction Time, min. | — | 120 | 120 | 120 |
| Conversion Yields (% dry, ash-free coal) | | | | |
| Ethylacetate Solubles | 4.2 | 10.0 | 8.5 | 10.3 |

TABLE 6-continued

| CONVERSION OF WYODAK SUBBITUMINOUS COAL BY AQUEOUS ALKALI TREATMENT | | | | |
|---|---|---|---|---|
| | Extraction of | Aqueous NaOH Treatment | | |
| | Unreacted Coal | Example 7A | Example 7B | Example 7C |
| Pyridine Solubles | 13.1 | 22.4 | 34.6 | 43.4 |
| Total Solubles | 17.3 | 32.4 | 43.1 | 53.7 |

EXAMPLE 8

Aqueous Phase Reactions of North Dakota Lignite in Mixed $Ca(OH)_2$/NaOH

This experiment illustrates the effect of $Ca(OH)_2$ and NaOH as mixed bases on aqueous phase depolymerization of North Dakota lignite. In the examples shown in Table 7, coal, water (6.0 gm/gm dry coal) and base were reacted under the vapor pressure of water at 170° C. for two hours. The acidified product was extracted by ethylacetate and pyridine to determine conversion to solubles.

Example 8A, conducted with pure $Ca(OH)_2$ (0.42 gm $Ca(OH)_2$/gm dry coal) shows only a slight increase of 3.5% over that of the unreacted coal. In Example 8B, Ca was replaced with Na such that the reaction media consisted of a mixture of 0.27 gm $Ca(OH)_2$ and 0.15 gm NaOH/gm of dry coal. In Example 8C, the Ca concentration was further decreased (0.15 gm $Ca(OH)_2$ and 0.27 gm NaOH/gm of dry coal). The total conversion increased an additional 7% (to 30.3%) over that of the unreacted coal. In the final Example (8D), all of the base consisted of NaOH (0.42 gm/gm dry coal) for comparison with the $Ca(OH)_2$ runs. The total conversion increased by only 26% over that of the unreacted coal.

In these examples it is seen that pure $Ca(OH)_2$ is not nearly as effective as pure NaOH in depolymerizing North Dakota lignite, as it is sparingly soluble in water and does not produce as high a pH as NaOH. Although it is even less soluble in the presence of NaOH, our results indicate that at least two-thirds of the NaOH can be replaced by $Ca(OH)_2$ without adversely affecting the depolymerization of North Dakota lignite.

EXAMPLE 9

Aqueous Phase Reactions of North Dakota Lignite in Mixed MgO/NaOH

This experiment illustrates the effect of MgO and NaOH as mixed bases on aqueous phase depolymerization of North Dakota lignite.

In the examples shown in Table B, coal, water (6.0 gm/gm dry coal) and base were reacted under the vapor pressure of water at 170° C. for two hours. The acidified product was extracted by ethylacetate and pyridine to determine conversion to solubles.

Example 9A shows that the total conversion to solubles increased by only 7.6% over that of the unreacted coal when the reaction media consisted of pure MgO as base (0.42 gm MgO/gm dry coal). In Example 9B, Mg was replaced with sodium such that the base consisted of a mixture of 0.27 gm MgO and 0.15 gm NaOH/gm of dry coal. The total conversion increased by 18.5% over that of the unreacted coal. When Mg is replaced by Na, as in Example 9C (0.15 gm MgO and 0.27 gm NaOH/gm of dry coal), the total conversion is only increased by an additional 3.6% (to 22.1%) over that of Example 9B. Example 8D is also included in Table 8 for comparison to represent the case where the base consists entirely of NaOH.

As with $Ca(OH)_2$ in Example 8, it is seen that pure MgO is not as effective as NaOH in depolymerizating North Dakota lignite. This is probably due to the same reasons of low solubility in water. MgO seems to be less effective than $Ca(OH)_2$ for replacing NaOH. But the results indicate that about a third of the NaOH can be replaced by MgO without adversely affecting the depolymerization of North Dakota lignite.

TABLE 7

| Conversion of North Dakota Lignite by Aqueous $Ca(OH)_2$/NaOH Treatment | | | | | |
|---|---|---|---|---|---|
| | Extraction of | Aqueous $Ca(OH)_2$/NaOH Treatment | | | |
| | Unreacted Coal | Example 8A | Example 8B | Example 8C | Example 8D |
| gm $Ca(OH)_2$/gm dry coal | — | 0.42 | 0.27 | 0.15 | 0 |
| gm NaOH/gm dry coal | — | 0 | 0.15 | 0.27 | 0.42 |
| Reaction Temp., °C. | — | 170 | 170 | 170 | 170 |
| Reaction Time, min. | — | 120 | 120 | 120 | 120 |
| Conversion Yields (% dry, ash-free basis) | | | | | |
| Ethylacetate Solubles | 2.3 | 2.3 | 5.3 | 4.4 | 6.2 |
| Pyridine Solubles | 3.7 | 7.2 | 24.0 | 31.9 | 25.8 |
| Total Solubles | 6.0 | 9.5 | 29.3 | 36.3 | 32.0 |

TABLE 8

| Conversion of North Dakota Lignite by Aqueous MgO/NaOH Treatment | | | | | |
|---|---|---|---|---|---|
| | Extraction of | Aqueous MgO/NaOH Treatment | | | |
| | Unreacted Coal | Example 9A | Example 9B | Example 9C | Example 8D |
| gm MgO/gm dry coal | — | 0.42 | 0.27 | 0.15 | 0 |
| gm NaOH/gm dry coal | — | 0 | 0.15 | 0.27 | 0.42 |
| Reaction Temp., °C. | — | 170 | 170 | 170 | 170 |
| Reaction Time, min. | — | 120 | 120 | 120 | 120 |
| Conversion Yields (% dry, ash-free basis) | | | | | |
| Ethylacetate Solubles | 2.3 | 3.2 | 4.7 | 6.7 | 6.2 |
| Pyridine Solubles | 3.7 | 10.4 | 19.8 | 21.4 | 25.8 |

TABLE 8-continued

| | Conversion of North Dakota Lignite by Aqueous MgO/NaOH Treatment | | | | |
|---|---|---|---|---|---|
| | Extraction of Unreacted Coal | Aqueous MgO/NaOH Treatment | | | |
| | | Example 9A | Example 9B | Example 9C | Example 8D |
| Total Solubles | 6.0 | 13.6 | 24.5 | 28.1 | 32.0 |

EXAMPLE 10

Aqueous Phase Reactions of North Dakota Lignite with NaOH: Effect of Temperature This experiment illustrates the effect of temperature on depolymerization of North Dakota lignite in aqueous NaOH.

In the experiment, coal, water (6.0 gm/gm dry coal) and NaOH (0.42 gm/gm dry coal) were reacted under the vapor pressure of water at temperatures ranging from 130° C. to 250° C. for two hours. The products were cooled and a solid product was separated by acidification with HCl. The acidified products were extracted with ethylacetate and pyridine. The solubility changes with temperature are shown in Table 9. Total conversion to solubles is substantial in the range 130°-170° C. (24-32%) but increases rapidly between 170°-210° C. (32-89%). Above 210° C. the conversion appears to remain constant with only 10% insoluble material remaining.

TABLE 9

| Conversion of North Dakota Lignite by Aqueous NaOH Treatment Effect of Temperature | | | | |
|---|---|---|---|---|
| | | Conversion Yields, % dry ash-free coal | | |
| Example | Reaction Temp., °C. | Ethylacetate Solubles | Pyridine Solubles | Total Solubles |
| Raw Coal | — | 2.3 | 3.7 | 6.0 |
| 10A | 130 | 4.8 | 19.2 | 24.0 |
| 8D | 170 | 6.2 | 25.8 | 32.0 |
| 10B | 190 | 9.1 | 42.8 | 51.9 |
| 10C | 210 | 14.4 | 75.1 | 89.5 |
| 2A | 250 | 23.3 | 64.1 | 87.4 |

EXAMPLE 11

Aqueous Phase Reactions of North Dakota Lignite with NaOH/$Na_2S$: Effect of Temperature This experiment illustrates the effect of temperature on depolymerization of North Dakota lignite in aqueous NaOH/$Na_2S$. Inferences on the effect of $Na_2S$ and experimental accuracy are also drawn.

In the examples shown in Table 10, coal, water (6.3 gm/gm dry coal), NaOH (0.42 gm/gm dry coal), and $Na_2S$ (0.18 gm/gm dry coal) were reacted under the vapor pressure of water at temperatures ranging between 110° C.-250° C. The insoluble products obtained upon HCl acidification were extracted with ethylacetate and pyridine.

The data in Table 10 show that the conversion of North Dakota lignite is substantial in the range of 110°-170° C., increases rapidly in the range of 170°-210° C., and essentially comes to completion at 250° C. These results are similar to those shown for aqueous NaOH in example 10. The major difference is at 250° C., where the addition of $Na_2S$ seems to convert the 10% residual insolubles of example 10 into pyridine soluble material in this example.

The accuracy of the conversion data in these experiments is ±2% for ethylacetate solubles and ±4% for pyridine solubles.

TABLE 10

| Conversion of North Dakota Lignite by Aqueous NaOH/$Na_2S$ Treatment Effect of Temperature | | | | |
|---|---|---|---|---|
| | | Conversion Yields, % dry ash-free coal | | |
| Example | Reaction Temp., °C. | Ethylacetate Solubles | Pyridine Solubles | Total Solubles |
| Raw Coal | — | 2.3 | 3.7 | 6.0 |
| 11A | 110 | 6.8 | 22.0 | 28.8 |
| 11B | 130 | 9.9 | 28.4 | 38.3 |
| | 130 | 5.3 | 19.3 | 24.6 |
| 11C | 170 | 10.6 | 30.6 | 41.2 |
| | 170 | 7.3 | 29.8 | 37.1 |
| 11D | 190 | 13.8 | 41.6 | 55.4 |
| | 190 | 10.6 | 33.8 | 44.4 |
| 11E | 210 | 14.2 | 68.7 | 82.9 |
| | 210 | 17.3 | 76.4 | 93.7 |
| 11F | 250 | 27.1 | 72.9 | 100.0 |
| | 250 | 24.3 | 75.7 | 100.0 |

EXAMPLE 12

Aqueous Phase Reactions of North Dakota Lignite in Mixed $Na_2CO_3$/$Na_2S$

This experiment illustrates the effect of a sodium carbonate and sodium sulfide mixture on aqueous-phase depolymerization of North Dakota lignite.

In the experiment, coal, water (4.5 gm/gm dry coal) and base (0.18 g $Na_2S$/gm dry coal and 0.42 g $Na_2CO_3$/gm dry coal) were reacted under the vapor pressure of water at 170° C. for 2 hours. The acidified product from the reaction was extracted by ethylacetate and pyridine. The conversion yields are shown in Table 11 with a comparison of unreacted coal and coal treated in NaOH/$Na_2S$. Although the substitution of $Na_2CO_3$ for NaOH decreases the yield of total solubles, the amount is appreciably better than unreacted coal.

TABLE 11

| Conversion of North Dakota Lignite By Aqueous $Na_2CO_3$/$Na_2S$ Treatment | | | |
|---|---|---|---|
| | Extraction of Unreacted Coal | Example 12 $Na_2CO_3$/$Na_2S$ Treatment | NaOH/$Na_2S$ Treatment |
| gm NaOH/gm dry coal | | 0 | 0.42 |
| gm $Na_2CO_3$/gm dry coal | — | 0.42 | 0 |
| gm $Na_2S$/gm dry coal | — | 0.18 | 0.18 |
| Reaction Temp., °C. | — | 170° C. | 170° C. |
| Reactors Time, min. | — | 120 | 120 |
| Conversion yields (% dry, ash-free basis) | | | |
| Ethylacetate Solubles | 2.3 | 6.2 | 10.6 |
| Pyridine Solubles | 3.7 | 21.5 | 30.6 |
| Total Solubles | 6.0 | 27.7 | 41.2 |

EXAMPLE 13

Aqueous Phase Reactions of North Dakota Lignite in the Presence of Ammonia-Based Mixtures This experiment illustrates the effect of adding $NH_4OH$ alone or in combination with either $(NH_4)_2S$ or $Na_2S$ for aqueous phase depolymerization of North Dakota lignite. In the experiments, coal, water (6 gm/gm dry coal) and base were reacted under the vapor pressure of water at 170° C. to 250° C. for 2 hours. The acidified products from the reactions were extracted with ethylacetate and pyridine to determine conversions to solubles. The results are shown in Table 12.

In example 13A, $NH_4OH$ treatment (0.42 gm $NH_4OH$/gm dry coal) had little effect on increasing the solubilities of the product compared to untreated coal. This result is consistent with the experiments (Examples 8 and 9) using pure $Ca(OH)_2$ or MgO, where it was shown that without sodium the pure bases alone had little effect.

In example 13B, sulfide addition (as $NH_4)_2S$) likewise shows only a slight increase over the untreated coal. However, in Example 13C, addition of Na to the ammonia mixture (as $NH_4OH/Na_2S$) has a considerable effect on depolymerization; the solubilities increased by as much as 54% over that of unreacted coal. It is apparent from these data that sodium is critical to the depolymerization reaction under the conditions of the experiment.

TABLE 12

Conversion of North Dakota Lignite by Aqueous $NH_4OH$ Treatment

| | Extraction of Unreacted Coal | Example 13A $NH_4OH$ | | Example 13B $NH_4OH/(NH_4)_2S$ | | | Example 13C $NH_4OH/Na_2S$ | | |
|---|---|---|---|---|---|---|---|---|---|
| gm $NH_4OH$/gm dry coal | — | 0.42 | 0.42 | 0.42 | 0.42 | 0.42 | 0.42 | 0.42 | 0.42 |
| gm $Na_2S$/gm dry coal | — | 0 | 0 | 0 | 0 | 0 | 0.18 | 0.18 | 0.18 |
| gm $(NH_4)_2S$/gm dry coal | — | 0 | 0 | 0.18 | 0.18 | 0.18 | 0 | 0 | 0 |
| Reaction Temp., °C. | — | 210 | 250 | 170 | 210 | 250 | 170 | 210 | 250 |
| Reaction Time, min. | — | 120 | 120 | 120 | 120 | 120 | 120 | 120 | 120 |
| Conversion Yields (% dry, ash-free basis) | | | | | | | | | |
| Ethylacetate Solubles | 2.3 | 2.9 | 3.8 | 2.9 | 3.2 | 2.9 | 4.8 | 7.2 | 10.4 |
| Pyridine Solubles | 3.7 | 9.4 | 8.0 | 8.7 | 9.2 | 5.3 | 15.3 | 27.2 | 49.2 |
| Total Solubles | 6.0 | 12.3 | 11.8 | 11.6 | 12.4 | 8.2 | 20.1 | 34.4 | 59.6 |

EXAMPLE 14

Aqueous-Phase Reactions of North Dakota Lignite with Sodium Hydroxide/Sodium Tetraborate This experiment was conducted to illustrate the addition of tetraborate as a substitute for $OH^-$ in sufficient amounts so that the mixture could be autocaustized to regenerate base. In the experiment, North Dakota lignite, water (6 gm/gm dry coal), and a mixture of NaOH (0.19 gm/gm dry coal) and $Na_2B_4O_7$ (0.15 gm/gm dry coal) were reacted at the vapor pressure of water for 2 hours at 250° C. Following the reaction, the mixture was observed to be unusually tar-like in appearance. After acidification, the insoluble portion was extracted with ethylacetate to yield 18.9% (dry, ash-free basis) solubles. This was in good agreement with that obtained for plain NaOH (Example 2A) where the yield was 14.4% solubles. In the NaOH run, the Na content was 0.24 gm/gm dry coal while the Na in the tetraborate experiment was only 0.15. The $OH^-$ concentration in the plain NaOH experiment was approximately twice that of the experiment with tetraborate.

EXAMPLE 15

Carbon Dioxide Neutralization of Base Mixtures With Depolymerized Coal

This experiment illustrates the ability of $CO_2$ to neutralize the base mixture from aqueous phase depolymerization of coal without forming a coal product precipitate. A 20 gm sample of depolymerized coal (pyridine extract) from NaOH treatment of North Dakota lignite was dissolved in 160 ml water containing 4 gm NaOH and 3 gm $Na_2B_4O_7$. The initial pH was recorded at 13.48. The mixture was heated to 50° C. and $CO_2$ was bubbled through the solution for 2 hours, after which the drop in pH was negligible. The final pH was recorded at 7.80, at which point no precipitation of the coal had occurred.

Such a mixture would be an ideal feedstock for slurry-type coal gasifiers, or as a transportable fluid for coal-water slurry applications.

The invention has been set forth in the several examples above using anthraquinone as the quinone catalyst and sodium hydroxide as the preferred alkali, as well as lignite as the preferred feed coal source. However, it is contemplated that various feeds and reactants may be utilized in the process of the present invention without departing from the scope of that invention. For example, in addition to anthraquinone, other quinones could be used, such as the group of compounds relevant as hydrogen-shuttle agents for the present invention including those cyclic diketones connected by conjugated double bond systems commonly referred to as "quinones" which are readily converted to the hydroquinone form by reduction under the aqueous alkaline conditions of the present process. As the simple benzo- or naptho-quinones are readily fragmented under these conditions via attack at the C—C double bond, the invention is limited to the three- or more-fused ring quinones which possess a unique resistance to attack by protection by the ring fusion. These would include the 9, 10 anthraquinone and its corresponding derivatives formed at the 1 to 4 or 5 to 8 positions on the following structure;

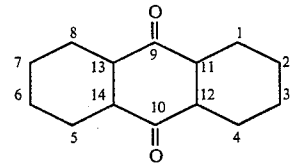

including methoxy-, halogenated (chloro-, fluoro-, bromo-), methyl-, ethyl-, propyl-, butyl-, carboxyl-, hydroxyl-, amino-, benz-, dibenz-, tetrabenz-, alkylbenz- and alkyldibenz-anthraquinones.

Other quinones consisting of the group of multi-fused ring quinones referred to commonly as polynuclear quinones or polyquinones and their corresponding alkyl substituents are also relevant to the present invention. Examples of these would include pyrene-, benzanthracene-, picene-, crysene-, dibenzanthracene-, and benzpyrene-quinones, may be utilized in the process of the present invention. Although it has been found that sodium hydroxide provides an improved result over such bases, as ammonium hydroxide, other alkali metal bases, such as hydroxides of Group IA and IIA elements may be utilized in the aqueous alkaline reaction medium of the process of the present invention. Further, as set forth above, coals in addition to lignite may be the subject of the present depolymerization process and these coals include high volatile B, and C, rank, bituminous coals, all sub-bituminous coals, lignite, brown coal and even peat. Other variables may be contemplated by those skilled in the art which variables are deemed to be within the scope of the invention.

Therefore, the scope of the invention should be ascertained from the claims which follow.

We claim:

1. A process depolymerizing solid raw coal selected from the group of bituminous, sub-bituminous and lignite coal, by the treatment of the coal in an aqueous alkaline medium in the presence of a quinone selected from the group comprising alkali stable quinones at a temperature of 110°–350° C. and in a hydrogen atmosphere at a partial pressure in the range of 500 to 3000 psi to product a depolymerized solid coal product.

2. The process of claim 1 wherein the quinone is anthraquinone.

3. The process of claim 1 wherein the alkaline medium constitutes sodium hydroxide.

4. The process of claim 1 wherein the quinone is present in a range of 0.01 to 8 wt % based upon feed coal.

5. The process of claim 1 wherein the starting alkaline medium is at a pH of 9 to 14.

6. The process of claim 5 wherein the pH is between 13 and 14.

7. The process of claim 1 wherein the total pressure is in the of 500 to 3500 psig.

8. The process of claim 1 wherein the depolymerized coal is recovered by extraction with supercritical ammonia.

9. The process of claim 1 wherein the quinone is a hydrogenated quinone.

10. A process for depolymerizing solid raw lignite coal to produce a significant ethylacetate soluble product by the treatment of the coal in aqueous alkaline sodium hydroxide solution in the presence of anthraquinone and a hydrogen atmosphere and a temperature in the range of 110°–350° C. and a pressure of 500–3500 psig to produce a depolymerized solid coal product.

11. The process of claim 10 wherein the temperature is approximately 250° C.

12. The process of claim 10 wherein the depolymerized coal is recovered by extraction with supercritical ammonia.

* * * * *

UNITED STATES PATENT AND TRADEMARK OFFICE

CERTIFICATE OF CORRECTION

PATENT NO. : 4,539,095

DATED : Sept. 3, 1985

INVENTOR(S) : S. Sunder and R. N. Miller

It is certified that error appears in the above-identified patent and that said Letters Patent is hereby corrected as shown below:

In Column 19, Line 31, the first occurrence of the word "--product--", should read --produce--.

Signed and Sealed this

*Third* Day of *June 1986*

[SEAL]

*Attest:*

DONALD J. QUIGG

*Attesting Officer*

*Commissioner of Patents and Trademarks*